US009777564B2

(12) United States Patent
Snow et al.

(10) Patent No.: US 9,777,564 B2
(45) Date of Patent: Oct. 3, 2017

(54) STIMULATING PRODUCTION FROM OIL WELLS USING AN RF DIPOLE ANTENNA

(71) Applicant: Pyrophase, Inc., Chicago, IL (US)

(72) Inventors: Richard H. Snow, Chicago, IL (US); Armin Hassanzadeh, Pearland, TX (US); Jack E. Bridges, Arlington Heights, IL (US)

( * ) Notice: Subject to any disclaimer, the term of this patent is extended or adjusted under 35 U.S.C. 154(b) by 652 days.

(21) Appl. No.: 13/692,199

(22) Filed: Dec. 3, 2012

(65) Prior Publication Data

US 2014/0152312 A1 Jun. 5, 2014

(51) Int. Cl.
*G01V 3/00* (2006.01)
*E21B 43/24* (2006.01)

(52) U.S. Cl.
CPC ..... *E21B 43/2401* (2013.01); *E21B 43/2408* (2013.01)

(58) Field of Classification Search
None
See application file for complete search history.

(56) References Cited

U.S. PATENT DOCUMENTS

| | | | |
|---|---|---|---|
| 4,140,179 | A | 2/1979 | Kasevich et al. |
| 4,196,329 | A | 4/1980 | Rowland |
| 4,207,452 | A | 6/1980 | Arai |
| 4,265,307 | A | 5/1981 | Elkins |
| RE30,738 | E | 9/1981 | Bridges |
| 4,320,801 | A | 3/1982 | Rowland |
| 4,508,168 | A | 4/1985 | Heeren |

(Continued)

FOREIGN PATENT DOCUMENTS

WO WO 2011/163156 12/2011

OTHER PUBLICATIONS

Baker-Jarvis, J. et al. "Mathematical Model for In Situ Oil Shale Retorting by Electromagnetic Radiation." Fuel. vol. 67, No. 7, Jul. 1988 (54 pages).

(Continued)

*Primary Examiner* — Minh N Tang
(74) *Attorney, Agent, or Firm* — The Law Firm of Andrea Hence Evan, LLC

(57) ABSTRACT

A dipole antenna system emplaced in a subsurface formation is configured to produce radio frequency (RF) fields for recovery of thermally responsive constituents in a subsurface formation. Coaxially disposed inner and outer conductors connected at an earth surface to an RF power source form a transmission line carrying power from the earth surface to a dipole antenna proximate said formation. The inner conductor protrudes from the outer conductor at a junction forming one pole of the antenna. The system also includes at least one choke structure attached to the outer conductor at a distance at least ¼ wavelength above said junction, confining the RF fields such that the exposed portion of the outer conductor between the junction and the choke forms a second pole of the antenna. The dipole system is configured to confine a majority of said RF fields in a volume of said formation situated adjacent to the antenna. The antenna deposits heat into the formation around an oil well independent of the flow of oil carrying heat back into the well. Such heating provides several mechanisms to enhance the flow of oil into a well.

24 Claims, 10 Drawing Sheets

(56) References Cited

U.S. PATENT DOCUMENTS

| | | | | |
|---|---|---|---|---|
| 5,293,936 | A | 3/1994 | Bridges | |
| 7,559,367 | B2 | 7/2009 | Vinegar | |
| 7,891,421 | B2 * | 2/2011 | Kasevich | 166/247 |
| 8,443,887 | B2 * | 5/2013 | Parsche | 166/302 |
| 8,789,599 | B2 * | 7/2014 | Parsche | 166/302 |
| 2010/0065265 | A1 | 3/2010 | Kasevich | |

OTHER PUBLICATIONS

Bowden, J. R. et al. "In Situ Retorting of Oil Shale Using RF Heating." Synfuels 5th Worldwide Symposium. Nov. 11-13, 1985 (22 pages).
Bridges, J. E. "Backscatter." IEEE Microwave Magazine: for the Microwave & Wireless Engineer. vol. 4, No. 4, Dec. 2003 (pp. 12 & 14).
Bridges, J. E. "In Situ RF Heating for Oil Sand and Heavy-Oil Deposits." Proceedings of the UNITAR III Conference on Tar Sands and Heavy Crudes. Jul. 1985 (11 pages).
Bridges, J. E. "Net Energy Recoveries for the In Situ Dielectric Heating of Oil Shale." Proceedings of the 11th Oil Shale Symposium. Apr. 12-14, 1978 (50 pages.).
Bridges, J.E. "Physical and Electrical Properties of Oil Shale." Fourth Annual Oil Shale Conversion Conference. Mar. 24-26, 1981 (48 pages).
Bridges, J. E. "Update on Radio-Frequency In Situ Extraction of Shale Oil." Proceedings of the 24th Oil Shale Symposium. vol. 83, No. 4, Winter 1988 (pp. 35-43).
Bridges, J. E. "Wind Power Energy Storage for In Situ Shale Oil Recovery with Minimal $CO_2$ Emissions." IEEE Transactions on Energy Conversion. vol. 22, No. 1, Mar. 2007 (pp. 103-109).
Carlson, R. D. "Development of IIT Research Institute RF Heating Process for In Situ Oil Shale/Tar Sand Fuel Extraction—An Overview." Institute for Clean and Secure Energy. Apr. 1981 (9 pages).
Fairley, P. "Electric Power: Steady as She Blows." IEEE Spectrum. vol. 40, No. 8, Aug. 2003 (pp. 35-39).
Johnson, H. R. et al. "Strategic Significance of America's Oil Shale Resource." United States Department of Energy, Office of Naval Petroleum and Oil Shale Reserves. Assessment of Strategic Issues, vol. I, Mar. 2004 (45 pages).
Justus, D. "Case Study 5: Wind Power Integration into Electricity Systems." International Energy Technology Collaboration and Climate Change Mitigation. Organisation for Economic Co-operation and Development. Mar. 2005 (32 pages).
Kleinberg, R. et al. "Oil Shale Formation Evaluation by Well Log and Core Measurements." Proceedings of the 30th Oil Shale Symposium. Oct. 2010 (18 pages).
Macchiarella, G. "Novel Approach to the Synthesis of Microwave Diplexers." IEEE Transactions on Microwave Theory and Techniques. vol. 54, No. 12, Dec. 2006 (pp. 4281-4290).
Mallon, R. G. "Economics of Shale Oil Production by Radio Frequency Heating." Lawrence Livermore Laboratory, University of California. May 7, 1980 (pp. 128-137).
McGee, B. C. "Electro-Thermal Pilot in the Athabasca Oil Sands: Theory Versus Performance." World Oil. vol. 229, No. 11, [online] Nov. 2008. Retrieved from the Internet: < URL: http://www.worldoil.com/November-2008-Electro-thermal-pilot-in-the-Athabasca-oil-sands-Theory-versus-performance.html> (12 pages).
McGee, B. C. "Power Losses in Steel Pipe Delivering Very Large Currents." IEEE Transactions on Power Delivery. vol. 17, No. 1, Jan. 2002 (pp. 25-32).
Phelan, J. et al. "Design, Demonstration and Evaluation of a Thermal Enhanced Vapor Extraction System." Sandia Report, SAND97-1251, Sandia National Laboratories. Aug. 1997 (183 pages).
Shapouri, H. et al. "The Energy Balance of Corn Ethanol: An Update." United States Department of Agriculture, Office of the Chief Economist, Office of Energy Policy and New Uses. Agricultural Economic Report No. 813, Jul. 2002 (pp. 1-16).
Sierra, R. "Promising Progress in Field Application of Reservoir Electrical Heating Methods." Society of Petroleum Engineers. SPE International Thermal Operations and Heavy Oil Symposium. Mar. 12-14, 2001 (pp. 1-17).
Snow, R. H. et al. "Comparison of Dielectric Heating and Pyrolysis of Eastern and Western Oil Shales." Proceedings of the 12th Oil Shale Symposium. Mar. 1979 (16 pages).
Snow, R. H. et al. "Control of In Situ Oil Production in Unconventional Resources by RF Heating (PyroArray)." Proceedings of the 30th Oil Shale Symposium, Colorado School of Mines. Oct. 2010 (12 pages).
Snow, R. H. et al. "The IITRI RF Process for Oil Shale—Recent Developments." Symposium Papers: Conference on Synthetic Fuels from Oil Shale II. Oct. 26-29, 1981 (pp. 367-390).
Sresty, G. C. et al. "Kinetics of Low-Temperature Pyrolysis of Oil Shale by the IITRI RF Process." Proceedings of the 15th Oil Shale Symposium. Apr. 28-30, 1982 (13 pages).
Streeter, W. S. "Economic Aspects of Oil Shale Production Using Radio-Frequency In Situ Retorting." 24th Oil Shale Symposium Proceedings. vol. 83, No. 4, Winter 1988 (pp. 44-50).
Stroemich, C. P. "Wellbore Power Transmission For In-Situ Electrical Heating." Alberta Oil Sands Technology and Research Authority (AOSTRA) Journal of Research. vol. 6, No. 4, Sep. 1990 (pp. 273-294).

* cited by examiner

FIG. 8
(PRIOR ART)
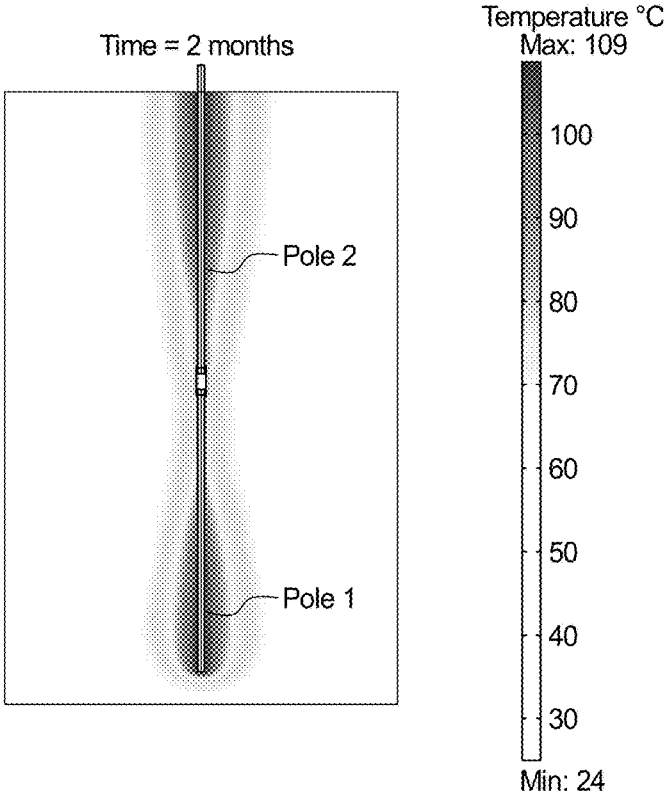
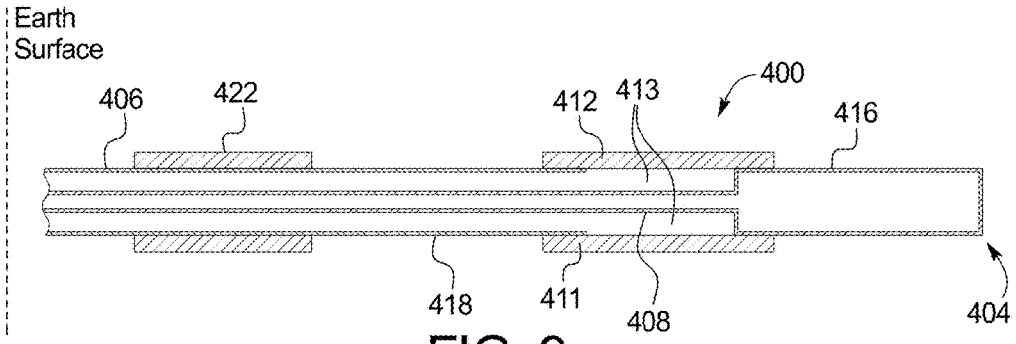
FIG. 9
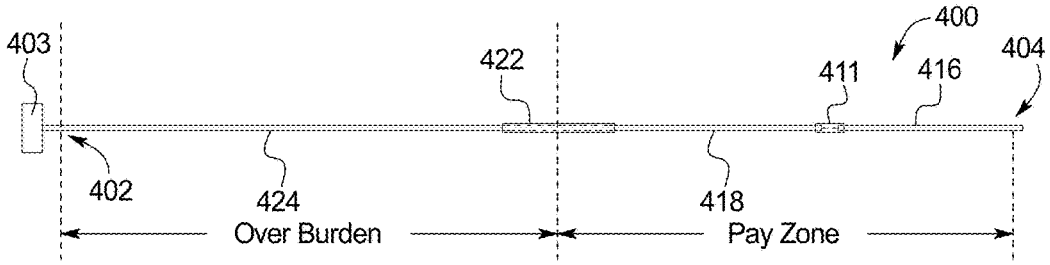
FIG. 10

STIMULATING PRODUCTION FROM OIL WELLS USING AN RF DIPOLE ANTENNA

FIELD OF THE INVENTION

This invention relates generally to oil production and, specifically, to stimulating production of oil by heating the formation around a well by an RF antenna heater tool inserted into the well.

BACKGROUND OF THE INVENTION

As the resources containing oils that are the easiest and cheapest to extract are being dissipated, it is becoming necessary to extract and produce oils that do not flow freely, which makes the extraction a more time, energy, and money consuming process. Some oils are more difficult to extract either because the oil is heavy and viscous, or because the formation has a low permeability. Heating is then required to raise the production rate of such oils to economic values.

SUMMARY

Generally, hydro carbonaceous deposits need to be heated to stimulate oil production. Several systems and methods for extracting oil from such deposits have been developed. Some conventional systems function by heating hydro carbonaceous deposits to stimulate oil production using RF energy by placing antennas in boreholes. It has been discovered that these conventional systems fail to deliver uniform heating to the formation. Such antennas usually act as monopoles; in other words they radiate preferentially from their ends, resulting in non-uniform heating. Antennas with non-uniform heating along their length may be uneconomic, since energy would be wasted in overheated sections, and under-heated sections would not be stimulated. Moreover, conventional systems waste a large amount of resources in extracting the oil. In other words, conventional systems are not efficient, making them impractical for widespread application. Moreover, it has been discovered that these conventional systems tend to suffer from dielectric breakdown, which is undesirable.

Other conventional systems operate by placing electrical resistance heaters into boreholes. These systems heat uniformly along the length, but the heat has to flow by thermal conduction from the heater to the casing and thence into the surrounding formation. Rocks have low thermal conductivity, so heat conduction is very time-consuming and requires a long time, in some cases, years. Moreover, heaters that rely on thermal conduction are limited to wells in which fluid inflow is small (e.g., on the order of 0.1 to 1 bb/day/m of well length. For systems where fluids being produced carry heat back into the well, fluid flow works against heat conduction and decreases the effectiveness of such heaters.

There is a need in the art for an RF antenna that can be inserted in a borehole such as an oil well so as to heat the formation uniformly along the length of the antenna and thus make efficient use of the RF energy.

Emplacing an antenna in a borehole requires an effective method of delivering power down to the antenna pay zone through a coaxial cable or transmission line, without losing heat to the overburden. The overburden is a layer of the earth covering a pay zone. The pay zone is a layer of the formation with elevated content of hydro carbonaceous material. Conventional systems and methods attempted to solve at least a part of this problem. However, the conventional systems and methods did not function as hypothesized. Moreover, the conventional systems and methods disclosed structures that often resulted in dielectric breakdown at points where fields were concentrated.

According to one aspect of the present invention, a system emplaced in a subsurface formation configured to produce radio frequency (RF) fields in said formation for recovery of thermally responsive constituents includes an inner conductor and an outer conductor. Said inner and said outer conductors are coaxially disposed tubular conductors connected at an earth surface to an RF power source, said inner and outer conductors forming a coaxial transmission line proximate said earth surface and a dipole antenna proximate said formation. Said inner conductor protrudes from said outer conductor from a junction exposing a gap between said inner and outer conductors to a deeper position within said formation. Said RF power source is configured to deliver, via the conductors, RF fields to said formation. The system also includes at least one choke structure attached to said outer conductor at a distance at least ¼ wavelength above said junction. The choke structure is configured to confine a majority of said RF fields in a volume of said formation situated adjacent to said antenna between the depth of said choke and a distal end of said inner conductor. Said distal end of said inner conductor opposes an end of said inner conductor that is connected at said earth surface to said RF power source.

According to a further aspect of the present invention, a method of heating a subsurface hydro carbonaceous earth formation includes forming a borehole into or adjacent to said formation and emplacing into said borehole an inner and an outer coaxially disposed tubular conductors. Each of the conductors is connected at an earth surface to an RF power source. The conductors form a coaxial transmission line proximate the earth surface and a dipole antenna proximate said formation. Said inner conductor protrudes from said outer conductor from a junction exposing a gap between said inner and said outer conductors to a deeper position within said formation. Said RF power source is configured to deliver, via the conductors, RF fields to said formation. The method further includes attaching at least one RF choke to said outer conductor at a distance at least about ¼ wavelength above the junction at the selected frequency of operation. The RF choke is configured to confine a majority of said heating within said electric fields situated in a volume of said formation adjacent to said RF antenna and situated between said choke and a distal end of said inner conductor. Said distal end of said inner conductor opposes an end of said inner conductor that is connected at said earth surface to said RF power source.

According to a further aspect of the present invention, a method of heating fluids contained in a volume of a formation adjacent to a buried RF dipole antenna structure includes forming a borehole into or adjacent to said formation. The method further includes emplacing into said borehole an inner and an outer coaxially disposed tubular conductors, the conductors each being connected at an earth surface to an RF power source. The conductors form a coaxial transmission line proximate the earth surface and a dipole antenna proximate said formation. The inner conductor protrudes from the outer conductor from a junction exposing a gap between the inner and the outer conductors to a deeper position within the formation. The RF power source is configured to deliver, via the conductors, RF fields to said formation so that said heating lowers a viscosity of said fluids and thereby increases a flow rate of said fluids from said formation into said inner conductor, said heating being independent of said flow rate.

Yet another aspect of the present invention relates to a method of increasing permeability of a volume of a formation adjacent to a buried RF dipole antenna structure. The method includes forming a borehole into or adjacent to said formation and emplacing into said borehole an inner and an outer coaxially disposed tubular conductors. The conductors are each connected at an earth surface to an RF power source. The conductors form a coaxial transmission line proximate the earth surface and a dipole antenna proximate said formation. Said inner conductor protrudes from said outer conductor from a junction exposing a gap between said inner and said outer conductors to a deeper position within said formation. Said RF power source is configured to deliver, via the conductors, RF fields to said formation, and heating said formation to a temperature of at least about 270° C., at which temperature organic material within said formation is converted to oil and gas, thereby opening pores in said formation and increasing the permeability to fluid flow.

A further aspect of the present invention relates to a method of producing channels for fluid flow in a volume of a formation adjacent to a buried RF dipole antenna structure. The method includes forming a borehole into or adjacent to said formation; and emplacing into said borehole an inner and an outer coaxially disposed tubular conductors. The conductors are each connected at an earth surface to an RF power source. The conductors form a coaxial transmission line proximate the earth surface and a dipole antenna proximate said formation. Said inner conductor protrudes from said outer conductor from a junction exposing a gap between said inner and said outer conductors to a deeper position within said formation. Said RF power source is configured to deliver, via the conductors, RF fields to said formation so as to heat said formation adjacent to said antenna to a temperature of at least 270° C., at which temperature differential thermal expansion of said formation produces stresses which cause fractures to form in said formation adjacent said antenna, and thereby to produce channels for fluid to flow into said inner conductor.

A further aspect of the present invention relates to a method of increasing recovery of oil in a steam-assisted gravity drive method, by pretreating a volume a formation adjacent to a buried RF dipole antenna structure. The method includes forming a borehole into or adjacent to said formation; and emplacing into the borehole an inner and an outer coaxially disposed tubular conductors. The conductors are connected at an earth surface to an RF power source. The conductors form a coaxial transmission line proximate the earth surface and a dipole antenna proximate said formation. The inner conductor protrudes from said outer conductor from a junction exposing a gap between the inner and the outer conductors to a deeper position within the formation. The RF power source is configured to deliver, via the conductors, RF fields to said formation, and heating said formation adjacent to said borehole to a temperature of at least about 270° C., so as to develop permeability along the length of said borehole, to provide a path for steam to flow from a whole length of the borehole into the formation.

Steam-assisted gravity drive (SAGD) includes injection of steam along the length of a horizontal well. It is difficult to initiate steam flow into the formation along the whole length of such a well, because steam tends to flow preferentially into areas of higher permeability, thus shorting flow into large parts of the well. As a result, oil is recovered from only a fraction of the reservoir. Pretreatment of the volume immediately around the well using the heater of the present invention can assist initiation of more uniform SAGD by developing permeability around the well. Absorption of heat by RF is governed mainly by presence of moisture. Practically all reservoir rock contains moisture within pores, so all of the volume around the well will be heated. Therefore, preheating can develop more uniform permeability around the well, and make the initial path for steam injection more uniform.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The foregoing and additional aspects, implementations and advantages of the present invention will become apparent to those of ordinary skill in the art upon reading the following detailed description and upon reference to the drawings, a brief description of which is provided next. The drawings are not necessarily to scale, emphasis instead being placed upon illustrating principles of various embodiments of the invention.

FIG. 8 is a temperature distribution diagram for the prior art structure of FIG. 6 after 2 months of heating at 2 MHz;

FIG. 9 illustrates an antenna configuration including a choke;

FIG. 10 illustrates an expanded scale view of the antenna configuration shown in FIG. 9;

FIG. 14 also illustrates in Curve 3 a wave of the present invention, intended to compensate for the tendency of heating waves to decline toward the ends of the antenna poles;

DETAILED DESCRIPTION

Figure 1:
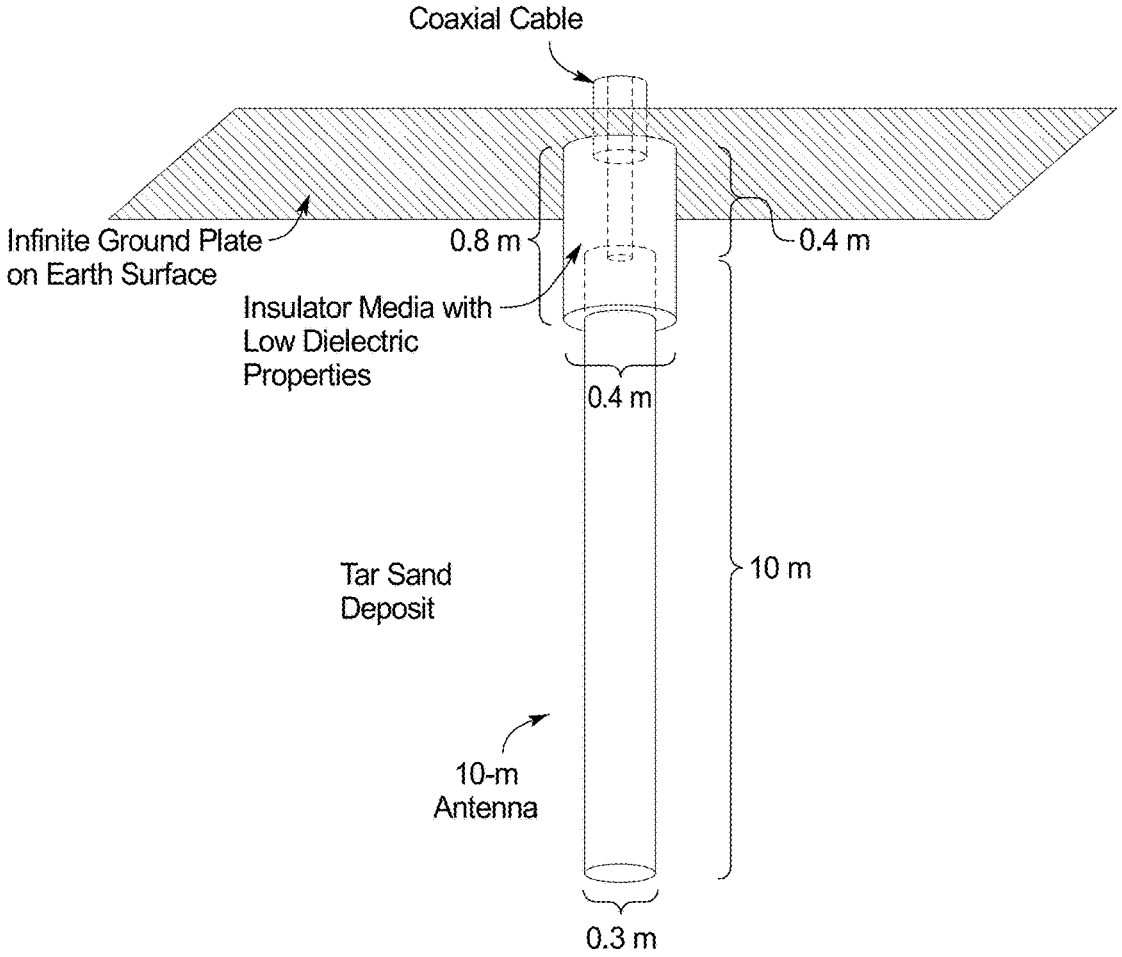
FIG. 1 (PRIOR ART)
FIG. 1 illustrates a prior art antenna or monopole connected at an RF source.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

A heater that can be installed in a borehole such as an oil well has a number of useful applications, some of which are described in a separate section below. For example, heating around the borehole can lower the viscosity of oil, increasing its flow rate into the well. Such heaters are of two main types: 1) Resistance heaters that produce heat in the well, and 2) RF antenna heaters that heat by producing RF fields and associated currents in the formation near the well. Resistance heaters depend on thermal conduction to transmit heat from the casing into the surrounding formation. RF heaters transmit energy directly into the surrounding formation, and heat the formation volumetrically. RF heaters may therefore be more effective in heating the formation and may transfer more heat. Although the energy falls off radially according to the reciprocal of radius squared, so that the energy is preferentially deposited near the antenna; thermal conduction helps to carry the heat further into the formation. Thus, RF heaters have two ways to carry heat into the formation, compared to one way for resistance heaters.

With an RF antenna, the surrounding formation is heated directly, and the heating process is not delayed due to the time-consuming thermal conduction process. Also, RF fields around an antenna are unaffected by fluid inflow, and deposit heat in the volume of the formation regardless of fluid inflow. Heat is carried back into the well by the very fluid inflow that the heater may seek to promote, and thus tends to counter the flow of heat by conduction.

Figure 18:
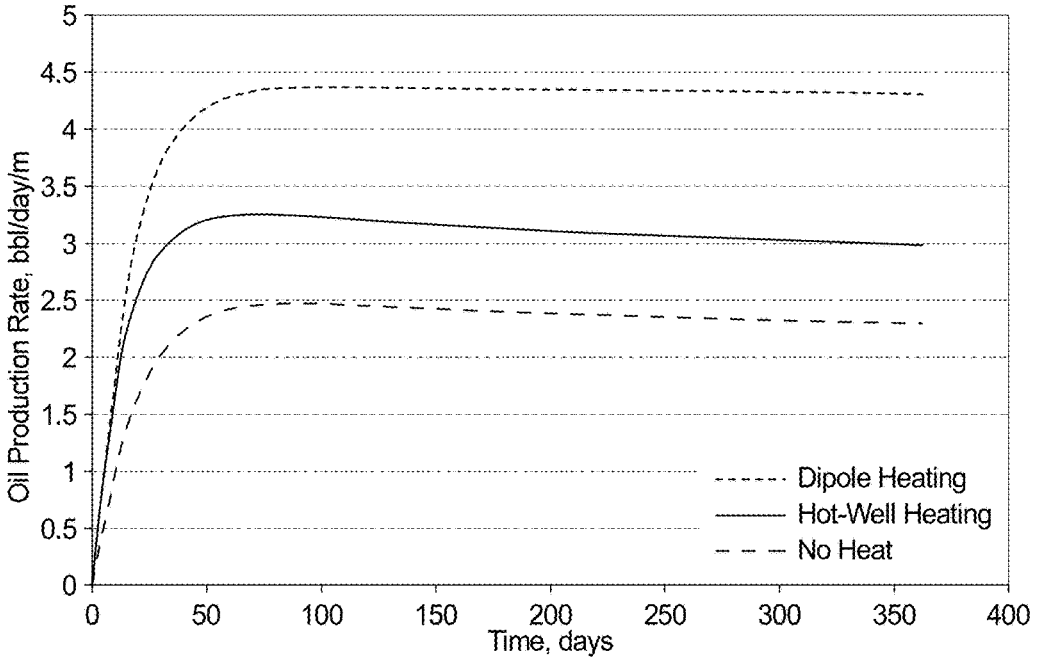
FIG. 18 is an oil production chart for a method of heating according to the present invention and two prior art methods for light oil in a low permeability formation.

Computer simulations below demonstrate how an RF antenna can more effectively heat a formation in the presence of larger fluid inflows than heaters that rely on thermal conduction. As a result the production rate is increased more by an RF antenna than by a resistance heater. This is an advantage, since wells with larger inflows are more productive and hence more efficient and economic. For example, FIG. 18 shows that a well with unheated production of 2.3 bbl/day/m can increase production by 30 percent with a resistance heater in the well, but by 2 bbl/day/m or 87 percent with a dipole heater. Heating within a few meters of the well is effective in increasing production because the cross-sectional area for flow into the well is the height times the diameter of a circle around the well. Closer to the well the circle becomes smaller and hence the resistance to flow is greater. Lowering the viscosity by heat overcomes this limitation.

A desirable range for oil viscosity around the well may be 10 to 500 centipoise (CP). Typical heavy oils may have viscosity of 1000 to several hundred thousand cp at reservoir temperature, which may range from 10 to 50° C. Viscosity varies in an exponential way with temperature, so that raising the temperature into the range of 50 to 120° C. may lower the viscosity into said desirable range.

An RF heater requires a transmission line to deliver power through an overburden to the heater. Because of the position of an RF choke in the present invention, unwanted RF heating from the transmission line is minimized; while uniform heating in an antenna long enough to heat an extended formation is made possible. The position of the choke in the system according to the present invention provides for two poles of the antenna; hence it is a Dipole antenna. Said position also allows for a heater as long as 1000 m with relatively uniform heating along its length.

Dielectric breakdown can occur at critical points in the antenna system where fields are intense. The present invention discloses methods to disperse such fields and prevent dielectric breakdown.

Conventional RF heaters that have previously been developed have not been successful as they are generally unable to achieve even heating rates along their length as a result of hot spots. The conventional RF heaters also have suffered from problems of dielectric breakdown at structural discontinuities where fields are concentrated.

FIG. 1 illustrates a prior art bare antenna or monopole connected to an RF source, with a ground plane (a flat metallic sheet) at the earth surface. In this example, the RF source is connected to the antenna through a short coaxial cable which passes through the ground plane. A specific set of dimensions is shown in FIG. 1, so that a computer simulation can be made by solving Maxwell equations:

$$\nabla \cdot B = 0$$

$$\nabla \times E = -\frac{\partial B}{\partial t}$$

Where B=magnetic field and E=electric field. The central conductor of the coaxial cable is coupled to a rod-like antenna. An insulator media with low dielectric properties surrounds the connection. In one aspect of the present invention, the antenna is a 10-m antenna. The axial length of the insulator media with low dielectric properties is 0.8 m. The diameter of the antenna with the insulator media with low dielectric properties surrounding it is 0.4 m. The diameter of the antenna without the insulator media is 0.3 m. The antenna may be inserted into a tar sand deposit.

A monopole is an antenna including only an emitter pole. A ground structure is located separately. The antenna is a rod-like structure which, when energized, produces RF fields and associated currents in the surroundings. When operated in open air, such fields can radiate far from the antenna, functioning as a broadcast antenna. When operated in a dielectric material such as soil, such fields and associated currents are absorbed and heat the nearby material. A coax is a coaxial arrangement of two tubular conductors used as a power transmittal structure.

Figure 2:
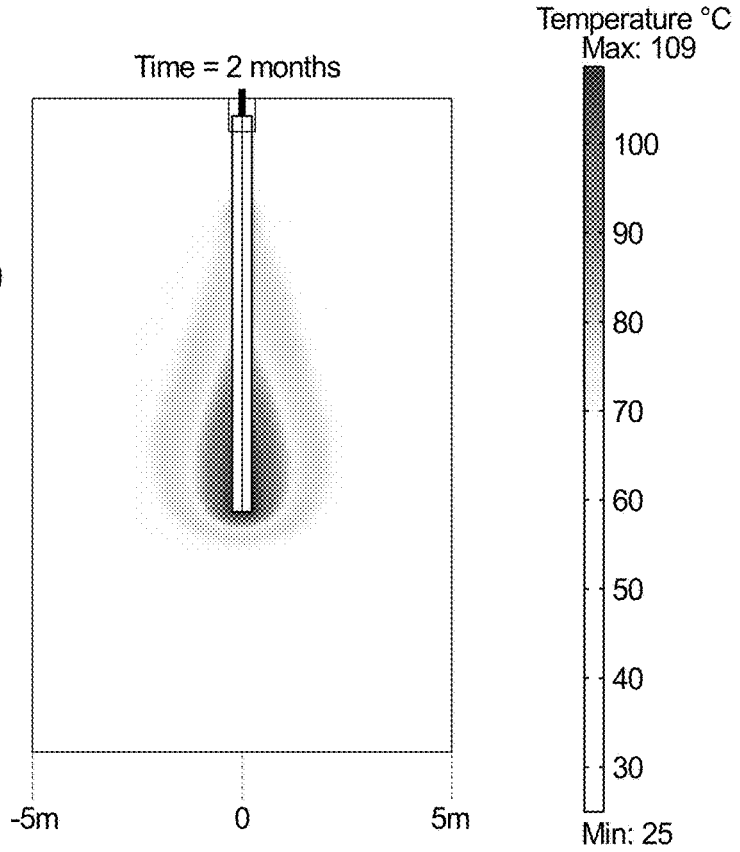
FIG. 2 (PRIOR ART)
FIG. 2 is a computer simulation showing how the electric fields around the prior art antenna of FIG. 1 heat up the surrounding formation at a frequency of 2 MHz.

A computer simulation based on the geometry of FIG. 1 shows the limitations of the monopole heating method. Electric fields around the antenna heat up the surrounding formation, e.g., tar sand deposit, as represented by the image in FIG. 2. At a frequency of 2 MHz after 2 months of heating, this geometry produces a hot spot at the distal end.

Figure 3:
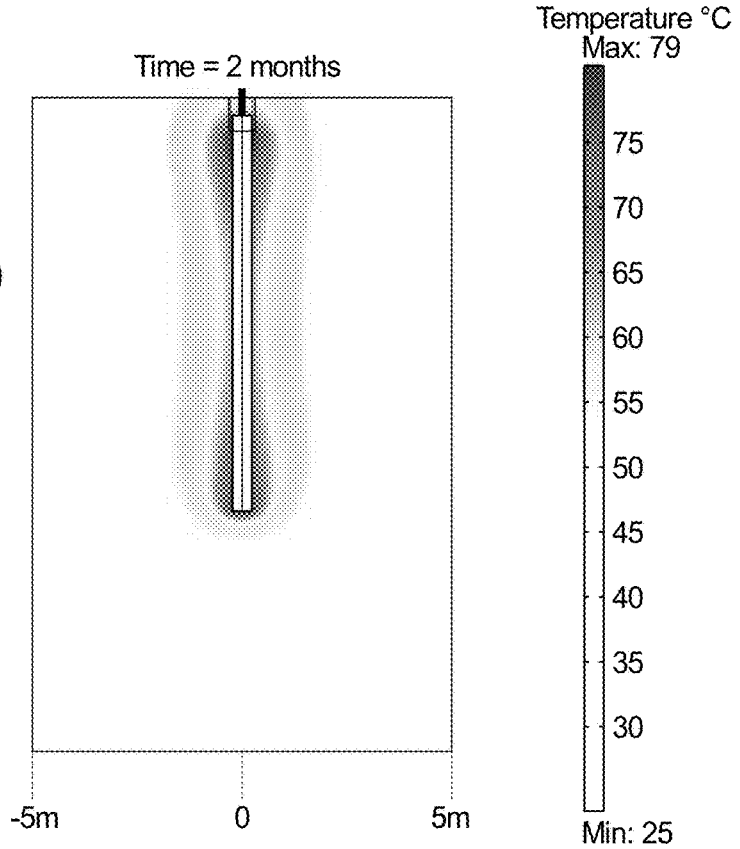
FIG. 3 (PRIOR ART)
FIG. 3 is a computer simulation showing how the electric fields around the prior art antenna of FIG. 1 heat up the surrounding formation at a frequency of 1 MHz.

At a different frequency, hot spots are also produced. FIG. 3 is a computer simulation that shows a diagram of how the electric fields around the antenna of FIG. 1 heat up the surrounding formation, e.g., tar sand deposit. In FIG. 3, at a frequency of 1 MHz at two months, hot spots appear at both the distal end and the proximal end of the antenna. These hot spots make the application of this antenna extremely limited, since the formation will be overheated at the two ends and under heated elsewhere. This simulation is based on dielectric properties of Utah tar sand, which is one potential application of the dipole RF heater of the present invention.

Figure 4:
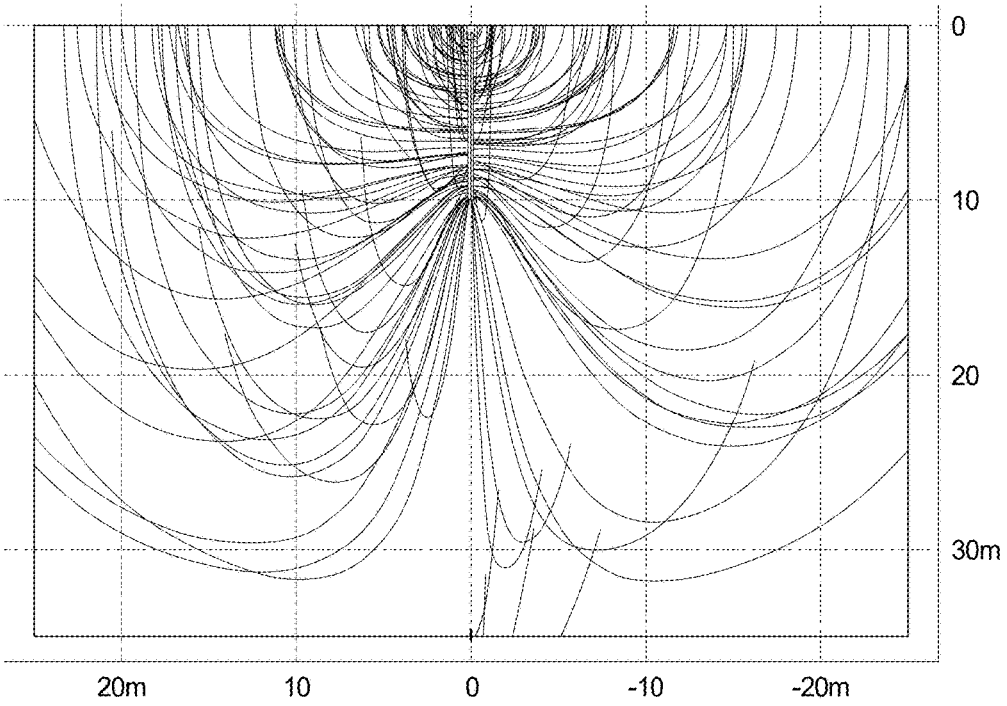
FIG. 4 (PRIOR ART)
FIG. 4 illustrates the electric field lines around the prior art antenna of FIG. 1.

FIG. 4 shows the electric field lines around the antenna of FIG. 1. Field intensity is high where the lines are closely spaced. FIG. 4 gives some idea of the reason for the hot spots, since it shows the electric field being concentrated at both ends. The field also extends out some distance into the formation at decreasing intensity, as may be inferred from the spacing between the field lines. In order to simplify the calculations a boundary was inserted at a radial distance 25 m from the antenna. As a result the near fields are accurately represented in the figure, while the weaker far fields are not accurate.

Figure 5:
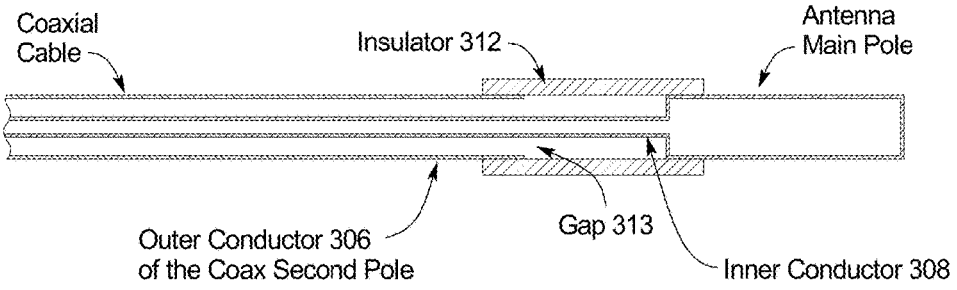
FIG. 5 (PRIOR ART)
FIG. 5 illustrates a prior art ceramic tube covering the junction where the inner conductor protrudes from the outer conductor.

FIG. 5 shows a coaxial transmission line connected to a protruding antenna, with a ceramic tube covering the junction where the inner conductor protrudes from the outer conductor. A practical down-hole heater should heat a formation that lies below a barren overburden without heating the overburden. Prior heaters such as that illustrated in FIG. 5 disclosed a method to connect an antenna to a coaxial cable or transmission line, said coax being intended to conduct the RF power down to the antenna. FIG. 5 shows how the inner conductor may protrude below the terminus of the outer conductor. The point of protrusion may be called a junction, where the inner conductor becomes one pole of the antenna below the junction. The outer conductor of a coax is the second pole. The field intensity is particularly high in the gap between the outer ground conductor and the inner excited conductor at the junction, because the gap is narrow. This is not a problem if this gap is filled with a gas with high dielectric strength like air, but if it comes in contact with soil or water, electric breakdown can occur. This issue may be improved by covering the exposed antenna junction with an insulator tube that can withstand heating as shown in FIGS. 5 and 6, such as a ceramic, so that the contained space is filled with air rather than with soil or moisture.

Additional protection against dielectric breakdown or arcing at this or other points in the structure may be provided by electronic control circuitry. Thermocouples or fiber optic temperature sensing devices may be installed at locations where breakdown is likely to occur. Then if temperature rises at such points more than in adjacent points the current may be reduced or temporarily interrupted until the breakdown heals. Additionally, control circuitry may be installed to limit current from the source to a selected value based on the desired heating rate, so that excessive draw is prevented from potential breakdown zones.

Figure 6:
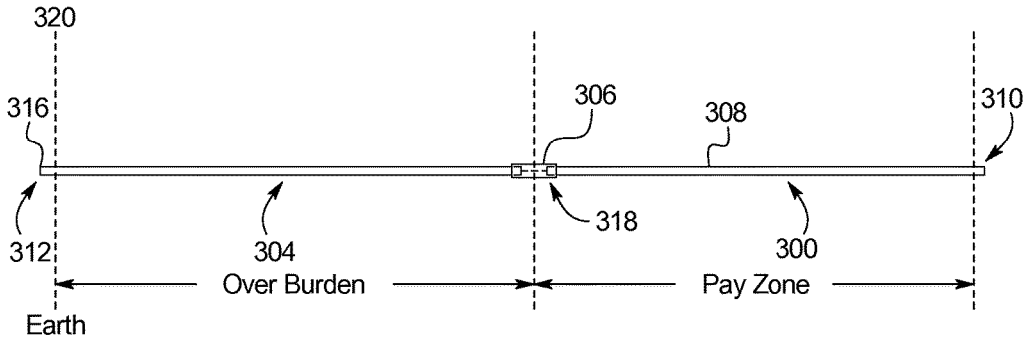
FIG. 6 (PRIOR ART)
FIG. 6 illustrates another prior art embodiment of an antenna connected to an RF source.

FIG. 6 shows the dimensions used for the computer simulations. FIG. 6 is a prior art heater system including a 10-m antenna main pole 300 including a distal end 310 and a proximal end 318 opposing the distal end 310. The antenna pole 300 is partly covered by an insulator 306 at its proximal end 318. The insulator 306 covers the connection between the outer conductor of the coaxial cable 304 and the junction where the inner conductor 300 protrudes to become part of the antenna pole 300. The coaxial cable 304 is connected to an RF excitation port 316 at the proximal end 312, of coaxial cable 304. There is no metallic ground plane in FIG. 6 as the outer conductor of the coax serves as the ground. FIG. 6 is shown rotated 90° to the left, so that the surface of the ground is at the left side 320.

Figure 7:
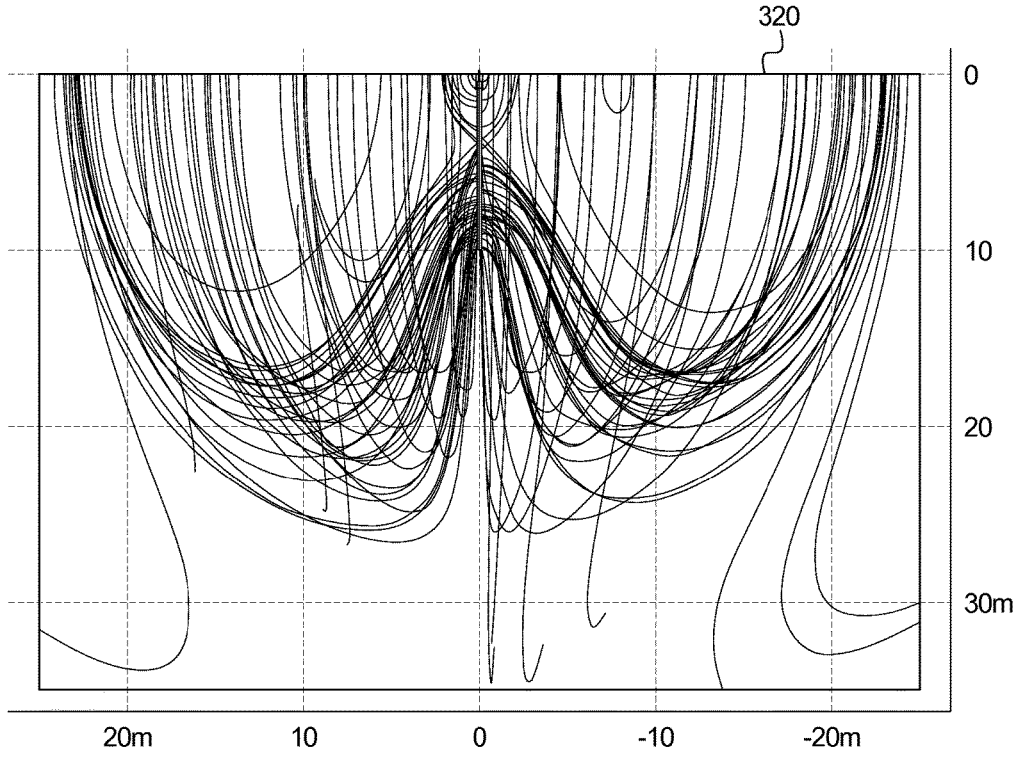
FIG. 7 (PRIOR ART)
FIG. 7 illustrates the electric fields around the prior art structure of FIG. 6.

FIG. 7 shows the electric fields around the structure of FIG. 6. The field lines fold back along the whole transmission line, as there is no choke. In FIG. 7 the field lines are only approximate away from the antenna, because only a finite region was simulated. Also for this reason the surface of the earth 320 still behaves to some extent as a ground.

FIG. 8 shows the temperature distribution for FIG. 6 after 2 months of heating at 2 MHz. In this case, the whole coax has become a part of the heater, and the heating pattern is still concentrated at the ends. This pattern is caused by the electric field lines which turn back from the part labeled main pole or pole 1, to the outer conductor surface, which becomes pole 2. Heating is higher near the two ends 310 and 312. As a result the overburden is heated undesirably near the end 312, and the pay zone is unevenly heated near the end 310.

FIGS. 9 and 10 show a configuration of a heating system 400 according to the present invention. FIG. 10 shows the heating system 400 but on an expanded scale. FIGS. 9 and 10 are rotated 90° to the left. The heating system 400 includes a proximal end 402 proximate the earth surface and a distal end 404 opposing the proximal end 402. The boundary between the overburden and the pay zone is preferably located at the choke 422. The distal end 404 is located within the subsurface pay zone formation. An RF power source 403 is provided above the earth surface. The system includes an outer conductor 406 and an inner conductor 408. The conductors 406 and 408 form a coaxial transmission line 424. The conductors 406 and 408 are connected to an RF source 403 at the earth surface. The inner conductor 408 extends longitudinally beyond the length of the outer conductor 406. Thus, the inner conductor 408 extends deeper into the formation towards the distal end 404. The end of the inner conductor 408 that extends beyond the outer conductor 406 forms a first pole 416. It may have an enlarged diameter section. A junction 411 defines the location where the outer conductor 406 ends and where the inner conductor 408 extends beyond the outer conductor 406. A gap 413 between the outer conductor 406 and the inner conductor 408 exists within the junction 411. The junction 411 is covered by an insulator 412. The insulator may be composed of a wide variety of materials including ceramics or plastics. The insulator overlaps a distal end of the outer conductor 406.

The system 400 includes a first antenna pole 416 and a second antenna pole 418. The insulator also overlaps the first antenna pole 416. The first antenna pole 416 is defined by the portion of the inner conductor 408 that extends beyond the outer conductor 406. The second pole 418 is defined by a portion of the outer conductor 406 that is located between the junction 411 and an RF choke 422. The choke 422 is mounted on the outer conductor 406 at least ¼ wavelength above the junction 411 where the inner conductor protrudes from the outer conductor 406. The inner conductor 408 and the outer conductor 406 define a coaxial cable 424 between the earth surface and the choke 422. The coaxial cable 424 extends through an overburden section. The coaxial cable 424 forms a transmission line from the RF power source 403 to the first antenna pole 416 and the second antenna pole 418. Said transmission line is intended to deliver RF energy to the first antenna pole 416 and the second antenna pole 418 without excessive waste of heat as said transmission line passes through an overburden.

In addition, to prevent wasteful heating of the transmission line coax due to a skin effect, the outer conductor may be lined with aluminum or copper, and the inner conductor may be coated with aluminum or copper. Thus, when current flows through these skin layers due to magnetic effects, the resistance of the skin layer will be low and little heat will be generated there. Alternatively, the coax tubing may be made entirely of non-magnetic metals.

A dipole is an antenna that includes within its structure both an emitter section and a ground section, referred to as separate poles. In this invention the dipole antenna is formed by the first pole 416 and the second pole 418. The dipole antenna produces electric fields which can heat a formation around a well, depositing energy within the volume of the formation adjacent to the antenna poles 416 and 418.

To control the axial uniformity of heating, the present invention attaches a ¼ wavelength choke 422 to the outer conductor 406 a distance at least another ¼ wavelength above the junction 411, as shown in FIG. 9. The choke 422 is a cup-shaped structure mounted on a transmission line and intended to prevent RF fields from passing around the choke 422. The choke may be clamped or press fitted or welded to the outer conductor so that it is electrically part of the outer conductor. Said choke 422 prevents most of the electric field lines from flowing past it toward the part of the coaxial cable 424 above the choke 422. It results in the outer conductor 406 of the coaxial cable 424 between the choke 422 and the junction 411 acting as the second antenna pole 418. The length of the second antenna pole 418 is chosen to be equal to the length of the first antenna pole 416. According to other aspects of the invention, the length of the first antenna pole 416 may differ from the length of the second antenna pole 418. The section axially above the choke 422 is the coaxial cable 424 that extends through the overburden and is surrounded by lower field intensities because of the choke 422.

Figure 11:
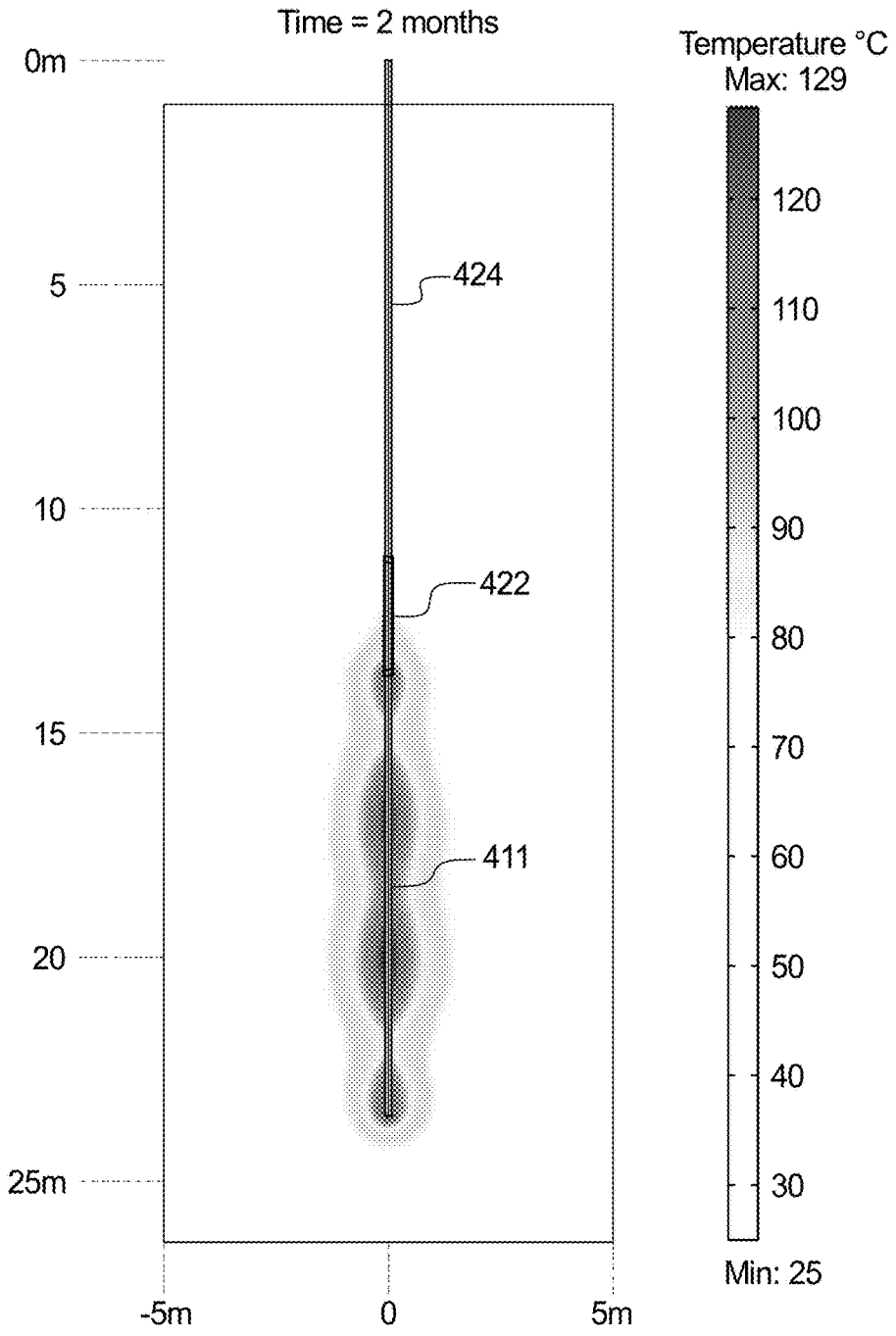
FIG. 11 is a temperature distribution diagram around the 10 m antenna of FIG. 9.

FIG. 11 shows that the choke 422 successfully blocks most of the RF electric fields from flowing back to the outer surface of the coax 404 above the choke 422, as revealed by the lack of heating peaks there. In FIG. 11 the top of the pay zone formation is located at depth 13 m, and the bottom of the formation is at 23 m.

According to one aspect of the present invention, a majority of heating is confined in RF fields situated in the portion of the formation adjacent to the first antenna pole 416 and the second antenna pole 418. The antenna poles 416 and 418 may be configured to heat the formation in a series of temperature peaks of substantially the same intensity along the length of said antenna poles 416 and 418. FIG. 11 shows the temperature distribution around the 10-m antenna configuration of FIGS. 9 and 10 after 2 months of heating at 15 MHz with the choke 422. FIG. 11 shows that heating occurs in four waves over the 10 m length of the antenna. Although the heating appears as waves, the pattern is smoother than the hot spots that appeared in the simulation of conventional heaters. The 5-m length of each pole 416 and 418 in this implementation amounts to ⅜ of the wavelength at this frequency.

Figure 12:
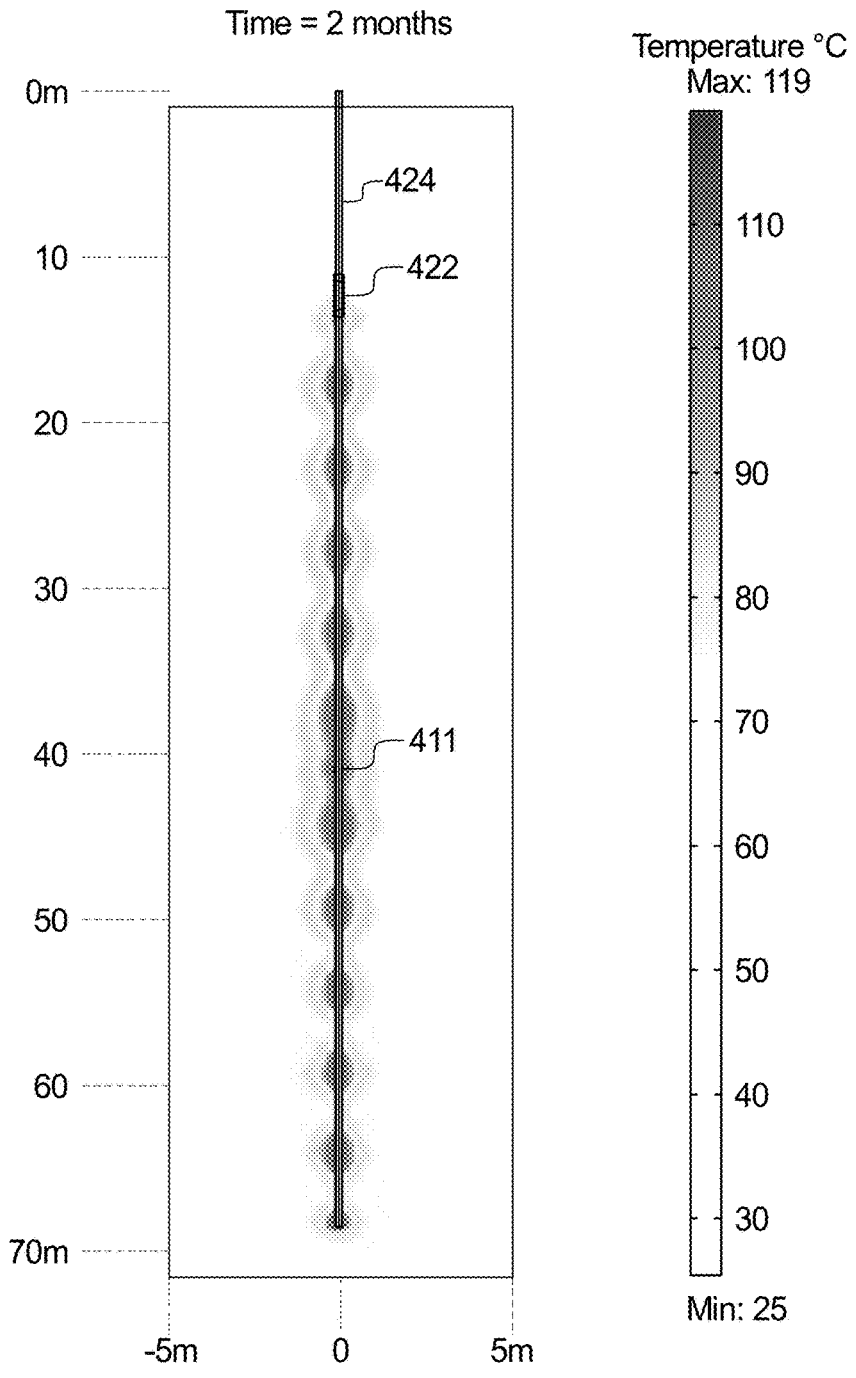
FIG. 12 is a temperature distribution diagram around a 55 m antenna. This is the same embodiment as FIG. 9 but with a 55 m antenna length.

The length of the first pole 416 and the second pole 418 may be longer than ¼ wavelength. The uniformity of heating is extended when the length of the poles is increased. To heat thicker formations in vertical wells or more extensive formations in horizontal wells which may extend tens or hundreds of meters, a longer heater is needed. Therefore a simulation was done with a dipole heater of similar design to that in FIGS. 9 and 10, but that extends for 55 m length, as shown in FIG. 12. FIG. 12 displays the temperature distribution around the antenna configurations of FIGS. 9 and 10 after 2 months of heating a 55-m antenna with coax. The frequency was 11 MHz, while the resonant frequency of the choke was 15 MHz. The length of each pole is 2 wavelengths. As seen in FIG. 12, the heating profile displays multiple peaks with substantially uniform size of heating, spaced along both poles of the antenna. The location of these waves can be shifted by altering the frequency so that the waves overlap and average out.

Figure 13:
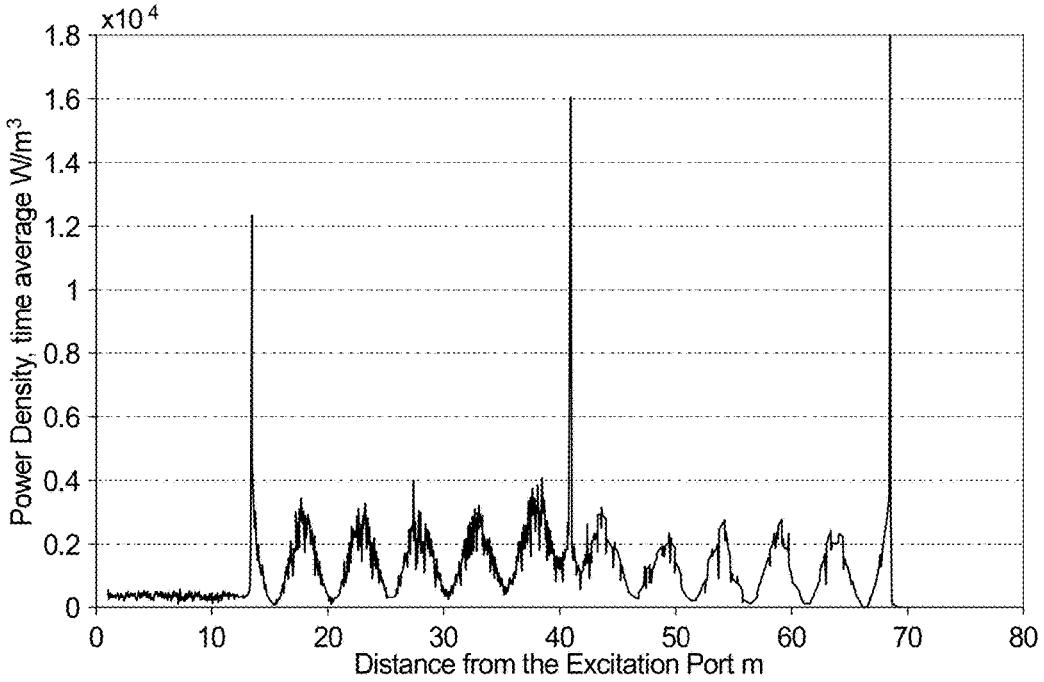
FIG. 13 is a chart of RF power density along the antenna of FIG. 12.

FIG. 13 represents a chart of RF power density along the antenna for the 55 m antenna with coax of FIGS. 9 and 10. The power peaks correspond to the heated zones along the length in FIG. 12. The sharp peaks result from discontinuities such as the end of the outer coaxial cable 411 and the end 404 of the pole 1 antenna 416. These sharp peaks do not result in sharp heating peaks in FIG. 12 because the heat flows to adjacent regions during the 2 months heating time. But these peaks represent points of field concentrations which may initiate dielectric breakdown in the surrounding medium. These peaks may be reduced by rounding the edges of the ends of the conductors and the chokes and by other methods.

Uniform heating is important for efficient use of applied energy. To further improve the uniformity of heating along the length of the formation, the RF power source 403 may be configured to apply at least two frequencies chosen to shift the location of peaks in the standing wave on the antenna, so that peaks at one frequency overlap valleys at another, as shown by curves 1 and 2 in FIG. 14. The first applied frequency may be chosen in the range of 1 to 100 MHz to produce a desired heating rate in the antenna at a suitable voltage such as about 1 to about 3000 volts. The choke is then configured with a length approximately ¼ of the wavelength at the chosen frequency. The second frequency is then selected to be approximately 10 to 40 percent above or below the first frequency, or an amount necessary to shift the location of heating peaks so that they overlap. This shifting may also be accomplished by adjusting the effective length of the transmission line by ¼ wavelength so that the peaks and nulls overlap. The frequencies or lengths may be alternated sequentially or they may be applied simultaneously.

Figure 14:
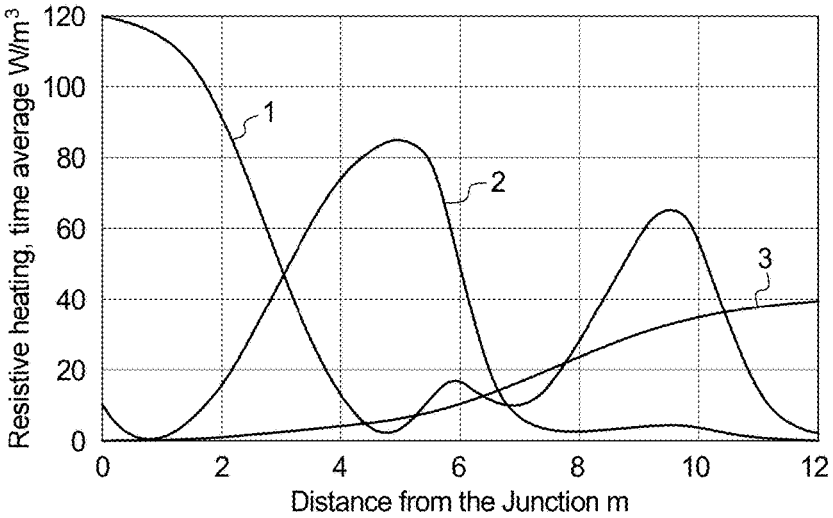
FIG. 14 illustrates a prior art example of overlapping standing waves in Curves 1 and 2.

The heating peaks 1 associated with the first frequency in FIG. 14 fall between the heating peaks 2 associated with the additional frequency so as to average the intensity of heating. The amplitudes of the heating peaks at each frequency may also be configured so as to result in most uniform heating along the length of the first antenna pole 416 and the second antenna pole 418. The amplitudes may be adjusted separately for each frequency.

Furthermore the height of the peaks in FIG. 12 and also in FIG. 14 is seen to diminish from the junction of the two dipoles, and is less at the ends of the dipoles. To compensate for this a third frequency in FIG. 14 is chosen with a ¼ wavelength equal to the length of one pole, with phase so that a null is located at the junction, and a peak at the other end of each pole. This wave, added to the others, will compensate for the tendency of heating peaks to decline with distance along each pole.

As the volume of the formation adjacent the first antenna pole 416 and the second antenna pole 418 becomes heated, the material properties of the formation, especially the dielectric absorption may change. For example the moisture, which mainly determines the dielectric absorption may evaporate, changing from 4 percent to less than 1 percent. Additional electronic circuitry such as variable capacitors or inductors may be combined with the RF source 403 in order to control and stabilize the frequency and the phase angle even as the material properties change with temperature. This is important to stabilize the position of heating peaks so that their positions may continue to overlap.

The computer simulations of FIGS. 1 to 13 are based on frequencies of 1 to 14 MHz. In another embodiment of this invention frequencies in the range of 1 to 1000 KHz may be used. At such lower frequencies the power loss in the transmission cable is greatly reduced, and yet useful RF heating still occurs around the antenna. Such lower frequencies may be particularly useful for deep wells where the power transmission section though the overburden is long.

In conclusion, the method of this invention can result in uniform heating along the length of the dipole antenna. The placement of the choke part way up the length of the coax transmission line turns the part of the line below the choke into the second pole of the dipole antenna, and the choke also decreases the fields around the transmission line above the choke.

Generally, chokes are used in antennas operating in open air, which is a low-loss material. The choke 422 in FIG. 9 and FIG. 10 is in direct contact with soil and moisture, which have high loss and can lead to dielectric breakdown. When a device such as a choke is deployed in a well and exposed to surrounding earth, special provisions are required to assure that the choke is sufficiently electrically robust to perform as expected while absorbing low amounts of power.

The tendency for breakdown can be reduced by filling the aperture of the choke 422 with low-loss dielectric material. Low loss dielectric materials include silica sand, ceramics, or inorganic cements or polymers. Said dielectric should be made of materials that absorb little moisture from the earth, since water has a high dielectric absorption. Said dielectric should not contain occlusions such as air bubbles, which tend to concentrate fields.

Figure 15:
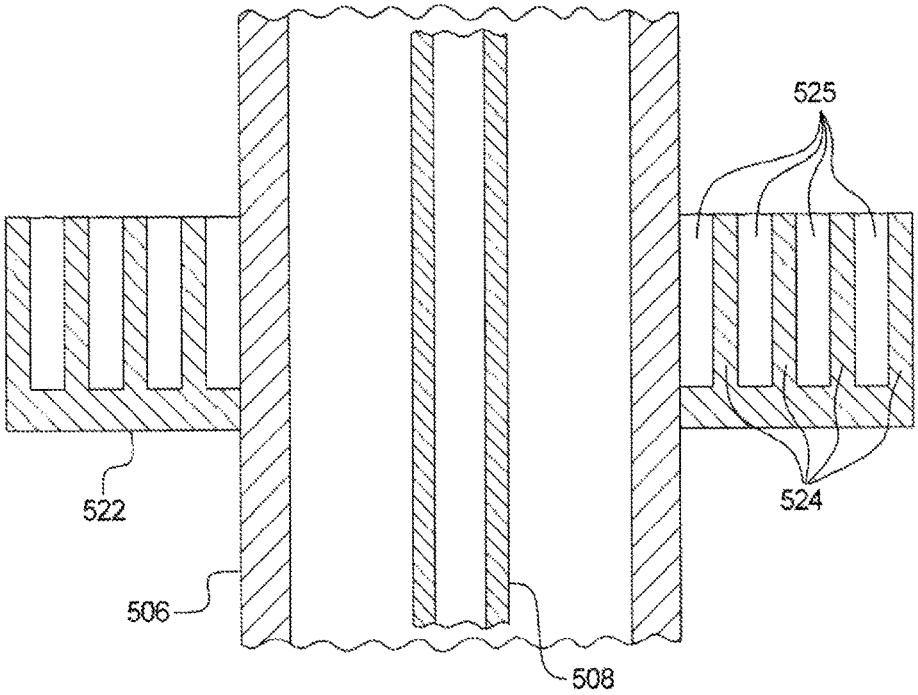
FIG. 15 illustrates a perspective view of a folded choke structure.

Choke structures normally present a concentration of electric fields at the aperture of their open end. FIG. 15 illustrates one implementation of a choke structure 422 that is configured to reduce the intensity of fields at said aperture. This implementation provides an effectively folded choke structure 522 so as to distribute the electric field over several apertures. By reducing the electric fields at the open aperture of a choke 525, this folded choke structure may further prevent or aid in preventing dielectric breakdown. Such a folded choke 522 includes two or more radially disposed folded layers 524. Such layers may also be described as welded together nested cups. Another way to prevent breakdown is to round the edges of the apertures 525 so as to limit peaks of electric fields.

The length of a choke determines its resonant frequency, which is important because the choke is most effective in blocking the resonant frequency and nearby frequencies from passing around the choke. The length of the choke 522 is about ¼ wavelength of the frequency selected to effectively operate the heater as described above, and the length of said circuitous folds of a folded choke structure is to be included in defining the ¼ wavelength of the choke structure.

Production of fluids from a formation may be increased by heating the formation near the well to lower the viscosity of the fluids contained in the formation. This method is effective because it heats the portion of the formation near the well, where flow lines converge and viscosity is most important. The temperature of oil at any point in a formation is the same as the temperature of the rock at the same point, because they are in intimate contact. Therefore heating of the formation near the well also heats the oil flowing into the well, lowering its viscosity. High viscosity near the well limits the production rate, because flow lines converge near the well, constricting the flow there. Lowering viscosity overcomes this problem.

Placing a resistance heater in a well can heat the well casing or wall, so that heat can then flow by thermal conduction into the surrounding media. Unfortunately when oil is then produced it carries heat back into the well, limiting the effect of thermal conduction.

Fields from an RF antenna on the other hand penetrate the surrounding media and heat it directly. The heat deposition then is largely independent of the flow of the fluids. RF energy is largely absorbed by moisture in the formation, regardless of whether the moisture is moving or not. The heat production is therefore not affected by fluid flowing into the well even though this fluid carries heat back in the direction of the well.

Figure 16:
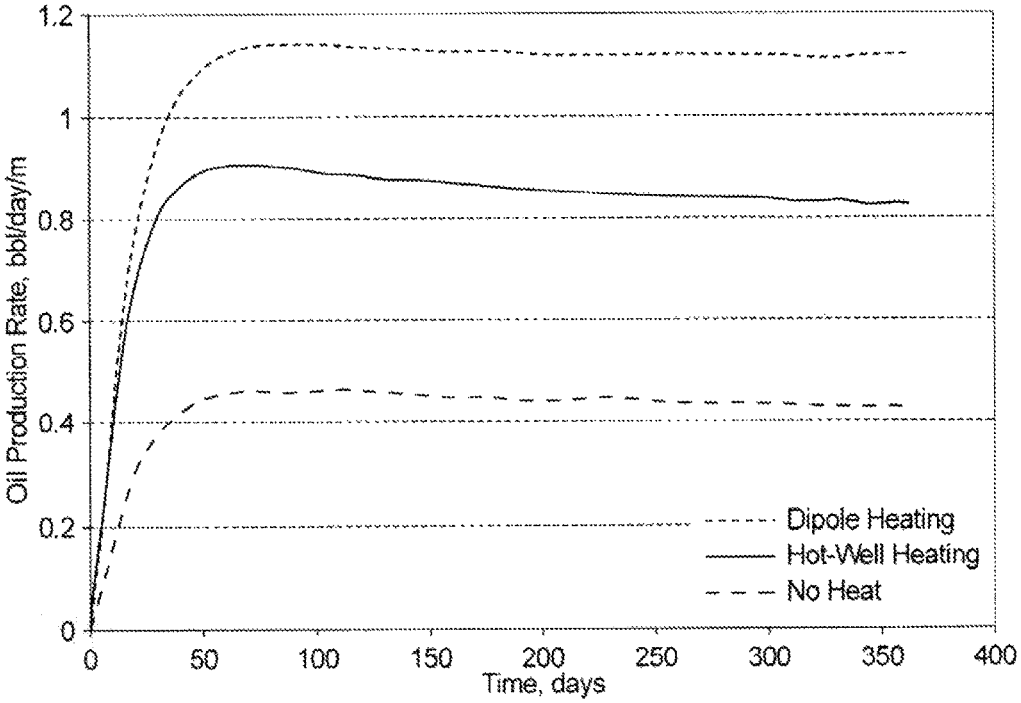
FIG. 16 is an oil production chart for a method of heating according to the present invention and two prior art methods for moderately heavy oil in a low permeability formation.
Figure 17:
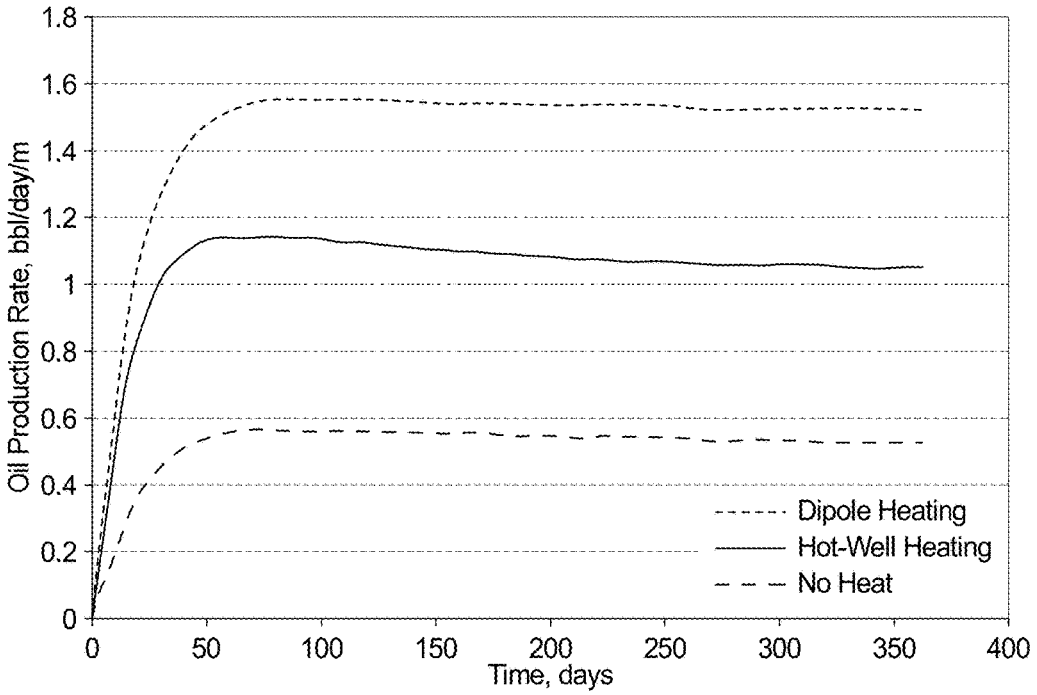
FIG. 17 is an oil production chart for a method of heating according to the present invention and two prior art methods for moderately heavy oil in a high permeability formation.

Simulations in three examples of FIGS. 16 to 18 were performed to determine the benefit in one application, the production of oil from a formation. In these examples the flow is limited either by the oil being heavy and having low viscosity at reservoir temperature, or being contained in a tight formation with low permeability. In each example, results from two heating methods are compared against unassisted flow. The examples represent heat deposition around a central well in the formation. The well was represented as a simple cylinder without including any details of heater construction. The methods are heating by an RF dipole heater, and heating by a resistance heater in a well.

For the case of the resistance heater the calculation was based on heat flow by conduction from the casing of the well into the surrounding rock. The casing was assumed to be heated at 200° C. In the RF dipole heater case they included heat production in the formation around the well based on the 1/r2 law, where r is the radial distance from the center of the well. Both cases included heat flow within the formation by conduction as well as by convection. The calculations of oil flow rate used reservoir engineering equations, based on permeability properties of the formation, and the viscosity of oil as a function of temperature. The formation permeability is specified for each example below. Reservoir pressure causing flow was assumed to be 2000 psi, while well pressure was 40 psi. Gravity was neglected as unimportant in these examples, so these examples can apply to horizontal wells, or vertical where the effect of pressure exceeds the effect of gravity.

FIG. 16 displays reservoir simulations showing the production rate of oil with time for the three methods of heating. The Dipole Heating curve represents the method of heating according to the present invention. This example is for moderately heavy oil (20° API) in a low permeability formation (100 mD). As seen in FIG. 16, production rate doubles with resistance heating as compared to unaided flow, and increases further with the Dipole Heater. The production rate for unaided flow was about 0.4 bbl/day/m. The production rate for hot-well resistance heating was about 0.85 bbl/day/m. The production rate for the dipole heating method according to the present invention was about 1.15 bbl/day/m. The desired production rate depends on economics, but is generally between 0.1 and 100 bbl/day/m. Accordingly, the method of production using the dipole heating method may be economic and practical for certain applications depending on the price of oil.

FIG. 17 displays reservoir simulations showing the production rate of oil with time for the same three methods of heating as in FIG. 16. This example is for heavy oil (14° API) in a high permeability formation (1000 mD). The production rate for unaided flow was about 0.55 bbl/day/m. The production rate for hot-well resistance heating was about 1.1 bbl/day/m. The production rate for the dipole heating method according to the present invention was about 1.55 bbl/day/m. Accordingly, the method of production using the dipole heating method may be economic and practical for certain applications depending on the price of oil.

FIG. 18 displays reservoir simulations showing the production rate of oil with time of heating for the same three methods as in FIGS. 16 and 17. This example is for moderately light oil (25° API) in a low permeability formation (100 mD). The unaided production is already substantial at about 2.4 bbl/day/m, so the oil flowing into the well can be expected to carry heat with it and accentuate the difference between the two heating methods. The production rate increases by about 30% with a well heated by the resistance method to about 3.2 bbl/day/m. The rate of production, as compared to the unaided flow, nearly doubles with the dipole heater according to the present invention, to about 4.4 bbl/day/m. Thus the dipole heater according to the present invention is almost 50% more effective in increasing production than hot-well heating. The rate of production with the dipole heater is high and is expected to be within the economic range generally desired by the oil industry.

The reason for the higher production rate with the dipole heater according to the present invention is that the delivery of heat into the deposit by the dipole heater is due to an electrical effect, and is not influenced by the flow of oil. Heat lowers the viscosity of oil in the deposit even when flow is relatively high (as much as 1 to 10 bbl/day/m). While the temperature rise is somewhat less than for the previous cases because flowing oil carries more heat back into the well, it is still effective in lowering the viscosity and increasing the oil flow rate. High flow also avoids overheating of oil when it enters the well. Therefore, in this example the dipole heater according to the present invention is especially applicable to wells with initially high, more economic production rate.

Additional Applications

The Dipole Heater has other applications. It may be used to heat and fracture tight formations by differential expansion of the rock near the well, generating pressures higher than those caused by hydraulic fracking. The RF antenna heater configuration may be used to produce fractures in the formation which provide channels to enhance flow of fluids into the well. The volume of a formation adjacent to a buried RF antenna structure may be heated to a temperature at least about 300° C. The difference between this temperature and that of the unheated rock further from the well produces stresses which cause fractures to form in the formation, which allow fluid to flow into the well. Stress calculations have shown that thermal stresses at this temperature can easily exceed rock breaking strength even under overburden pressure.

In another implementation of the present invention fluid flow may be enhanced by heating the formation near the well to pyrolysis temperature, converting organic matter in pores to oil and gas and opening up pores for fluid flow. The dipole heater according to the present invention may be used to heat rock near the well to temperatures of 270° C. or more. At this temperature the organic content in pores will be pyrolyzed, converting said content to gases and liquids that can flow out of the pores. This in turn leaves pores open to flow and makes the rock more permeable. This treatment can improve the injectivity of liquids, for example to aid hydraulic fracking. The increased permeability near the well can also improve the flow rate of fluids into the well, since it lowers the resistance to flow in the zone near the well where flow lines converge. This effect is in addition to the effect of heat on viscosity of oil flowing into the well.

In yet another application, the heater of the present invention can improve initiation of steam-assisted gravity drive (SAGD). SAGD requires injection of steam along the length of a horizontal well. It is difficult to initiate steam flow into the formation along the whole length of such a well, because steam tends to flow preferentially into areas of higher permeability, thus shorting flow into large parts of the well. As a result, oil is recovered from only a fraction of the reservoir.

Pretreatment of the volume immediately around the well using the heater of the present invention can assist initiation of more uniform SAGD by developing permeability around the well. Absorption of heat by RF is governed mainly by presence of moisture. Practically all reservoir rock contains moisture within pores, so all of the volume around the well will be heated. Therefore preheating can develop more uniform permeability around the well, and make the initial path for steam injection more uniform.

Heating produces permeability by several mechanisms. 1) Raising the temperature of heavy oil in pores around the well can lower viscosity and cause oil to flow out of pores and down by gravity toward the production well. This leaves pores open for steam to flow. 2) By heating to 270° C. in a zone around the well, any organic matter in pores is pyrolyzed, converted to gas and liquid, which again can flow down toward the producing well and leave open pores. 3) Heating to 270° C. can cause rock near the well to expand. Such differential expansion can produce fractures near the well, again producing paths to initiate steam flow.

Computer simulations in FIGS. 17 to 19 show how these mechanisms can increase the flow of heavy oil flow into a producer well. Conversely, these mechanisms can increase the flow of steam from the well into the reservoir, and thus aid in initiating SAGD.

While particular embodiments and applications of the present disclosure have been illustrated and described, it is to be understood that this disclosure is not limited to the precise construction and compositions disclosed herein and that various modifications, changes, and variations can be apparent from the foregoing descriptions without departing from the spirit and scope of the invention as defined in the appended claims. It is further understood that embodiments may include any combination of features and aspects described herein.

What is claimed is:

1. A dipole antenna system emplaced in a subsurface formation configured to produce radio frequency (RF) fields in said formation for recovery of thermally responsive constituents, said system comprising:

an inner conductor and an outer conductor, said inner and said outer conductors being coaxially disposed tubular conductors connected to an RF power source at an earth surface, said inner and outer conductors forming a coaxial transmission line extending from said RF power source proximate said earth surface to a dipole antenna proximate said formation, wherein said inner conductor protrudes from said outer conductor from a junction forming a protrusion that acts as a first pole of said dipole antenna; and at least one choke structure attached to said outer conductor at a distance at least ¼ wavelength above said junction at the protrusion which causes an exposed portion of the outer conductor located between the junction and the said at least one choke to act as a second pole of said dipole antenna, and wherein the said at least one choke structure is configured to confine a majority of said RF fields in a volume of said formation situated adjacent to said first and second poles of said dipole antenna between the depth of said choke and a distal end of said inner conductor, said coaxial transmission line being configured to deliver RF power from said RF power source to said junction and thence to said first and second poles of said dipole antenna which then deliver said RF power to said formation.

2. The system according to claim 1 wherein said first and second poles being configured to heat said formation in a series of temperature peaks of substantially the same intensity along the length of said first and second poles.

3. The system according to claim 1, wherein a first frequency supplied by the RF source is chosen to produce the desired power delivery and heating rate in the heater at a voltage that is delivered by the power source and transmitted by a power transmission section, and said at least one choke is designed to have an electrically effective length of about ¼ wavelength at said first frequency.

4. The system according to claim 1, wherein the at least one choke structure is electrically robust and is configured to resist dielectric breakdown when exposed to conditions present in oil wells.

5. The system according to claim 4, wherein the at least one choke structure includes at least one aperture filled with a dielectric material that retains its low-loss properties when exposed to the surrounding earth formation, so as to resist breakdown and minimize power loss.

6. The system according to claim 4, wherein the at least one choke structure includes rounded edges configured to minimize RF field concentration areas and avoid dielectric breakdown.

7. The system according to claim 4, wherein the at least one choke structure includes a nested cup-shaped tubular member including at least two radially disposed folded layers, the at least one choke structure including a plurality of apertures and being configured to distribute the RF fields among said plurality of apertures and to thereby reduce an intensity of said RF fields and prevent dielectric breakdown.

8. The system according to claim 1, wherein control circuitry is combined with the RF source to limit current to a value selected to produce a desired heating rate while limiting excess current flow and thus limiting dielectric breakdown at any points within the system.

9. The system according to claim 1, wherein temperature sensors are inserted at points where high field strength is expected, the temperature sensors being configured to limit or temporarily shut down current flow when temperature at such high field strength points exceeds temperature at adjacent points.

10. A method of heating a subsurface hydro carbonaceous earth formation, composing:

forming a borehole into or adjacent to said formation;

emplacing into said borehole inner and outer coaxially disposed tubular conductors, the conductors each being connected at an earth surface to an RF power source, the conductors forming a coaxial transmission line proximate the earth surface and a dipole antenna proximate said formation, said inner conductor protruding from said outer conductor from a junction forming a protrusion, said RF power source being configured to deliver, via the conductors, RF fields to said formation wherein said protrusion of said inner conductor serves as a first pole of said dipole antenna; and attaching at least one RF choke to said outer conductor at a distance at least about ¼ wavelength above the junction at the protrusion at a selected frequency of operation, the RF choke being configured to confine a majority of said heating within said RF fields situated in a volume of said formation adjacent to said dipole antenna, and situated between said choke and a distal end of said inner conductor, said distal end of said inner conductor opposing an end of said inner conductor that is connected at said earth surface to said RF power source wherein a section of said outer conductor situated between said choke and said junction serves as a second pole of said dipole antenna, and wherein said first and second poles are configured to heat said formation in a series of temperature peaks of substantially same intensity along a length of said first and second poles.

11. The method of claim 10, further comprising lowering a viscosity of fluids located in said volume of said formation adjacent to said dipole antenna and thereby increasing a flow rate associated with said fluids from said formation into said inner conductor via a sump or via perforations in said inner conductor, said heating by said RF fields being independent of said flow rate.

12. The method of claim 10 wherein said volume of said formation adjacent to said antenna is heated by said RF fields to a temperature of at least about 270° C., such that organic material within said formation is converted to oil and gas, thereby opening pores in said formation and increasing permeability to fluid flow adjacent and into said antenna.

13. The method of claim 10, wherein said volume of said formation adjacent to said dipole antenna is heated by said RF fields to a temperature of at least about 270° C., so that differential thermal expansion of the formation produces stresses which cause fractures to form adjacent said dipole antenna and thereby produces channels for fluid within said formation to flow into said inner conductor of said antenna.

14. A method of heating fluids contained in a volume of a formation adjacent to a buried RF dipole antenna structure comprising:

forming a borehole into or adjacent to said formation; and emplacing into said borehole an inner and an outer coaxially disposed tubular conductors, the conductors each being connected at an earth surface to an RF power source, the conductors forming a coaxial transmission line proximate the earth surface and a dipole antenna proximate said formation, said inner conductor protruding from said outer conductor from a junction exposing a gap between said inner and said outer conductors to a deeper position within said formation, said RF power source being configured to deliver, via the conductors, RF fields to said formation; so that said heating lowers a viscosity of said fluids and thereby increases a flow rate of said fluids from said formation into said inner conductor, said heating being independent of said flow rate, wherein said protruding section of said inner conductor serves as a first pole of said dipole antenna and a second pole of said dipole antenna is defined as a portion of said coaxial transmission line extending from said junction in an opposite direction from said first pole of said dipole antenna to a point before said earth surface.

15. A method of increasing permeability of a volume of a formation adjacent to a buried RF dipole antenna structure comprising:

forming a borehole into or adjacent to said formation; and emplacing into said borehole an inner and an outer coaxially disposed tubular conductors, the conductors each being connected at an earth surface to an RF power source, the conductors forming a coaxial transmission line proximate the earth surface and a dipole antenna proximate said formation, said inner conductor protruding from said outer conductor from a junction exposing a gap between said inner and said outer conductors to a deeper position within said formation, said RF power source being configured to deliver, via the conductors, RF fields to said formation, and heating said formation to a temperature of at least about 270° C., at which temperature organic material within said formation is converted to oil and gas, thereby opening pores in said formation and increasing the permeability to fluid flow, wherein said protruding section of said inner conductor serves as a first pole of said dipole antenna and a second pole of said dipole antenna is defined as a portion of said coaxial transmission line extending from said junction in an opposite direction from said first pole of said dipole antenna to a point below said earth surface.

16. A method of producing channels for fluid flow in a volume of a formation adjacent to a buried RF dipole antenna structure comprising:

forming a borehole into or adjacent to said formation; and emplacing into said borehole an inner and an outer coaxially disposed tubular conductors, the conductors each being connected at an earth surface to an RF power source, the conductors forming a coaxial transmission line proximate the earth surface and a dipole antenna proximate said formation, said inner conductor protruding from said outer conductor from a junction exposing a gap between said inner and said outer conductors to a deeper position within said formation, said RF power source being configured to deliver, via the conductors, RF fields to said formation so as to heat said formation adjacent to said antenna to a temperature of at least 270° C., at which temperature differential thermal expansion of said formation produces stresses which cause fractures to form in said formation adjacent said antenna, and thereby to produce channels for fluid to flow into said inner conductor, wherein said protruding section of said inner conductor serves as a first pole of said dipole antenna and a second pole of said dipole antenna is defined as a portion of said coaxial transmission line extending from said junction in an opposite direction from said first pole of said dipole antenna to a point below said earth surface.

17. A method of increasing recovery of oil in a steam-assisted gravity drive method, by pre-treating a volume of a formation adjacent to a buried RF dipole antenna structure, the method comprising:

forming a borehole into or adjacent to said formation; and emplacing into said borehole an inner and an outer coaxially disposed tubular conductors, the conductors each being connected at an earth surface to an RF power source, the conductors forming a coaxial transmission line proximate the earth surface and a dipole antenna proximate said formation, said inner conductor protruding from said outer conductor from a junction exposing a gap between said inner and said outer conductors to a deeper position within said formation, said RF power source being configured to deliver, via the conductors, RF fields to said formation, and heating said formation adjacent to said borehole to a temperature of at least about 270° C., so as to develop permeability along the length of said borehole, to provide a path for steam to flow from a whole length of said borehole into said formation, wherein said protruding section of said inner conductor serves as a first pole of said dipole antenna and a second pole of said dipole antenna is defined as a portion of said coaxial transmission line extending from said junction in an opposite direction from said first pole of said dipole antenna to a point below said earth surface.

18. A system emplaced in a subsurface formation configured to produce radio frequency (RF) fields in said formation for recovery of thermally responsive constituents, said system comprising:

an inner conductor and an outer conductor, said inner and said outer conductors being coaxially disposed tubular conductors connected at an earth surface to an RF power source, said inner and outer conductors forming a coaxial transmission line proximate said earth surface to a dipole antenna proximate said formation, wherein said inner conductor protrudes from said outer conductor from a junction exposing a gap between said inner and outer conductors to a deeper position within said formation; and at least one choke structure attached to said outer conductor at a distance at least ¼ wavelength above said junction, wherein the choke structure is configured to confine a majority of said RF fields in a volume of said formation situated adjacent to said dipole antenna between the depth of said choke and a distal end of said inner conductor, said distal end of said inner conductor opposing an end of said inner conductor that is connected at said earth surface to said RF power source, wherein the RF power source is configured to deliver a first frequency and at least a second frequency in addition to said first frequency, wherein the first and the second frequencies both have values within 40 percent of a resonant frequency of said choke to produce a standing wave, the first frequency being different from the second frequency, the second frequency being selected such that heat peaks associated with the second frequency fall between heat peaks associated with the first frequency so as to average a heating intensity and produce substantially uniform heating along said length of said first and second poles; and wherein one additional frequency is chosen with such a frequency and phase as to provide single peaks of heating at ends of said poles and a null at the junction between said poles, so as to compensate for the tendency of heating peaks to decline toward the ends of said conductors.

19. The system according to claim 18, wherein the length of said coaxial transmission line is effectively altered sequentially by about ¼ wavelength to shift said peaks of heating such that heat peaks associated with the second pole's length fall between heat peaks associated with the first pole's length so as to average a heating intensity and produce substantially uniform heating along said length of said first and second poles.

20. A method of heating a subsurface hydro carbonaceous earth formation, comprising:

forming a borehole into or adjacent to said formation; emplacing into said borehole an inner and an outer coaxially disposed tubular conductors, the conductors each being connected at an earth surface to an RF power source, the conductors forming a coaxial transmission line proximate the earth surface and a dipole antenna proximate said formation, said inner conductor protruding from said outer conductor from a junction exposing a gap between said inner and said outer conductors to a deeper position within said formation, said RF power source being configured to deliver, via the conductors, RF fields to said formation; and attaching at least one RF choke to said outer conductor at a distance at least about ¼ wavelength above the junction at a selected frequency of operation, the RF choke being configured to confine a majority of said heating within said electric fields situated in a volume of said formation adjacent to said dipole antenna, and situated between said choke and a distal end of said inner conductor, said distal end of said inner conductor opposing an end of said inner conductor that is connected at said earth surface to said RF power source, wherein the RF power source is configured to deliver a first frequency chosen to produce a desired power delivery and heating rate in a heater at a voltage that may be practically delivered by the RF power source and transmitted by a power transmission section, and one or more additional frequencies, wherein the first frequency has a value within 40 percent of a resonant frequency of said RF choke to produce standing waves, the first frequency being different from the one or more additional frequencies; the one or more additional frequencies being selected such that heat peaks associated with the one or more additional frequencies fall between heat peaks associated with the first frequency so as to average a heating intensity and produce substantially uniform heating along said length of said first and second poles; and wherein one of said one or more additional frequencies is chosen with a frequency and phase to provide single peaks of heating at ends of each of said poles and a null at the junction between said poles, so as to compensate for the tendency of heating peaks to decline toward the ends of said conductors.

21. The method of claim 20, wherein amplitudes associated with said heating peaks are adjusted separately for each frequency, so as to fit said peaks together in such a way as to produce substantially uniform heating along said length of said first and second poles.

22. The method of claim 21, further comprising stabilizing said first and the one or more additional frequencies, via tuning electronic circuitry that is combined with said RF power source, by balancing any change in phase due to varying dielectric properties of materials as they are heated.

23. The method of claim 20, wherein the first frequency and the one or more additional frequencies are alternated sequentially.

24. The method of claim 20, wherein the first frequency and the one or more additional frequencies are applied simultaneously.

* * * * *